US010890075B2

(12) United States Patent
Jung

(10) Patent No.: US 10,890,075 B2
(45) Date of Patent: Jan. 12, 2021

(54) TURBINE BLADE HAVING SQUEALER TIP

(71) Applicant: DOOSAN HEAVY INDUSTRIES & CONSTRUCTION CO., LTD., Changwon-si (KR)

(72) Inventor: Sung Chul Jung, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 75 days.

(21) Appl. No.: 16/294,957

(22) Filed: Mar. 7, 2019

(65) Prior Publication Data

US 2019/0309635 A1 Oct. 10, 2019

(30) Foreign Application Priority Data

Apr. 4, 2018 (KR) ..... 10-2018-0039291

(51) Int. Cl.
*F01D 5/18* (2006.01)
*F01D 5/20* (2006.01)

(52) U.S. Cl.
CPC ..... *F01D 5/20* (2013.01); *F01D 5/186* (2013.01); *F05D 2240/307* (2013.01); *F05D 2260/202* (2013.01)

(58) Field of Classification Search
CPC ..... F01D 5/186; F01D 5/20; F05D 2240/307; F05D 2260/202
See application file for complete search history.

(56) References Cited

U.S. PATENT DOCUMENTS 5,192,192 A * 3/1993 Ourhaan ..... F01D 5/18 415/115
5,660,523 A 8/1997 Lee
6,494,678 B1 * 12/2002 Bunker ..... F01D 5/18 415/115
7,922,451 B1 4/2011 Liang
8,066,485 B1 11/2011 Liang
8,113,779 B1 2/2012 Liang
9,273,561 B2 * 3/2016 Lacy ..... F01D 5/186
(Continued)

FOREIGN PATENT DOCUMENTS

JP 2015-524895 A 8/2015
KR 10-2003-0077023 A 9/2003
(Continued)

*Primary Examiner* — Ninh H. Nguyen
(74) *Attorney, Agent, or Firm* — Invenstone Patent, LLC

(57) ABSTRACT

Disclosed is a turbine blade including a blade part having an airfoil in a cross section having a leading edge, a trailing edge, and a pressure surface and a suction surface connecting the leading edge and the trailing edge, the blade part extending radially from a platform part to a tip portion as a free end in the turbine blade, wherein a cavity through which cooling air flows is formed inside the turbine blade, wherein a squealer tip having a predetermined thickness protrudes along an edge of the tip portion so that a squealer pocket is formed on an inner side of the tip portion by the squealer tip, wherein the squealer tip is provided with a cooling hole communicating with the cavity along a radial direction of the turbine blade, and wherein an undercut is formed around the cooling hole of the squealer tip by cutting a part of the squealer tip in a circumferential direction.

15 Claims, 6 Drawing Sheets

(56) References Cited

U.S. PATENT DOCUMENTS

| | | | | |
|---|---|---|---|---|
| 9,470,096 | B2 * | 10/2016 | Mishra | F01D 5/186 |
| 9,856,739 | B2 | 1/2018 | Bedrosyan et al. | |
| 10,156,144 | B2 * | 12/2018 | Quach | F01D 5/187 |
| 2012/0282108 | A1 | 11/2012 | Lee et al. | |
| 2016/0319672 | A1 * | 11/2016 | Jones | F01D 5/20 |

FOREIGN PATENT DOCUMENTS

| | | | |
|---|---|---|---|
| KR | 10-2004-0071045 | A | 8/2004 |
| WO | 2017-001801 | A1 | 1/2017 |

* cited by examiner

TURBINE BLADE HAVING SQUEALER TIP

CROSS REFERENCE TO RELATED APPLICATION

The present application claims priority to Korean Patent Application No. 10-2018-0039291, filed on Apr. 4, 2018, the entire contents of which are incorporated herein for all purposes by this reference.

BACKGROUND OF THE DISCLOSURE

1. Field of the Disclosure

The present disclosure relates to a turbine blade of a gas turbine and, more particularly, to a turbine blade having on an end side thereof a squealer tip with radially perforated cooling holes.

2. Description of the Background Art

The turbine is a mechanical device that obtains a rotational force by an impact force or reaction force using a flow of a compressible fluid such as steam or gas. The turbine includes a steam turbine using steam and a gas turbine using high temperature combustion gas.

The gas turbine is mainly composed of a compressor, a combustor, and a turbine. The compressor is provided with an air inlet for introducing air, and a plurality of compressor vanes and compressor blades, which are alternately arranged in a compressor casing. The air introduced from outside is gradually compressed through the rotary compressor blades disposed in multiple stages up to a target pressure.

The combustor supplies fuel to the compressed air compressed in the compressor and ignites a fuel-air mixture with a burner to produce a high temperature and high pressure combustion gas.

The turbine has a plurality of turbine vanes and turbine blades disposed alternately in a turbine casing. Further, a rotor is arranged to pass through the center of the compressor, the combustor, the turbine and an exhaust chamber.

Both ends of the rotor are rotatably supported by bearings. A plurality of disks is fixed to the rotor so that the respective blades are connected, and a drive shaft such as a generator is connected to an end of the exhaust chamber.

Since these gas turbines have no reciprocating mechanism such as a piston in a 4-stroke engine, there are no mutual frictional parts like piston-cylinder. Accordingly, the gas turbines consume an extremely small amount of lubricating oil, so that a high speed operation may be possible.

During the operation of the gas turbine, the compressed air in the compressor is mixed with fuel and combusted to produce a high-temperature combustion gas, which is then injected toward the turbine. The injected combustion gas passes through the turbine vanes and the turbine blades to generate a rotational force, which causes the rotor to rotate.

SUMMARY OF THE DISCLOSURE

The factors that affect the efficiency of gas turbines vary widely. The gas turbine technology has been developing in various aspects such as, improvement of combustion efficiency in the combustor, improvement of thermodynamic efficiency through an increase in turbine inlet temperature, and improvement of aerodynamic efficiency in the compressor and the turbine.

Here, it is important to control a gap in the compressor blade and the turbine blade tip or to reduce an amount of leakage gas to improve the aerodynamic efficiency in the compressor and the turbine. For example, a specified gap may be formed between the blade tip and an inner surface of the casing in consideration of thermal expansion in a high temperature environment and the contact during rotational movement. However, gas may escape through this gap (e.g., air in the compressor and combustion gas in the turbine).

Therefore, the control of the leakage gas at the blade tips is important in the design of the gas turbine, and there is also a necessity to develop the gas turbine which is stable in operation and advantageous in maintenance in a high temperature and high pressure environment.

Accordingly, the present disclosure has been made keeping in mind the above problems occurring in the related art, and an object of the present disclosure is to provide a turbine blade having a squealer tip capable of effectively reducing leakage of hot gas through a tip gap without causing a plugging problem even when tip rubbing occurs in the turbine blade.

In an aspect of the present disclosure, a turbine blade including a blade part having an airfoil in a cross section including a leading edge, a trailing edge, and a pressure surface and a suction surface connecting the leading edge and the trailing edge, the blade part extending radially from a platform part to a tip portion as a free end in the turbine blade, wherein a cavity through which cooling air flows is formed inside the turbine blade, wherein a squealer tip having a predetermined thickness protrudes along an edge of the tip portion so that a squealer pocket is formed on an inner side of the tip portion by the squealer tip, wherein the squealer tip is provided with a cooling hole communicating with the cavity along a radial direction of the turbine blade, and wherein an undercut is formed around the cooling hole of the squealer tip by cutting a part of the squealer tip in a circumferential direction.

The cooling hole of the squealer tip may be formed on at least a pressure surface among the pressure surface and a suction surface on the airfoil in cross section.

The cooling holes may be formed on both the pressure surface and the suction surface on the airfoil in cross section such that the cooling holes respectively formed on the pressure surface and the suction surface are staggered so as not to overlap with each other with respect to the circumferential direction.

The cooling holes formed on the suction surface side may be located along a line extending in a direction orthogonal to the pressure surface at an intermediate point of two adjacent cooling holes formed on the pressure surface side.

The cooling holes formed on the pressure surface side may be formed to discharge cooling air in a direction parallel to the radial direction.

The cooling holes formed on the suction surface side may be formed in an inclined manner to discharge the cooling air in a direction toward the squealer pocket.

An edge forming a boundary between an upper surface of the squealer tip and the undercut may be chamfered or a fillet-machined.

The squealer pocket may be provided with a cooling hole communicating with the cavity along the radial direction of the turbine blade.

The undercut may be incised obliquely with respect to the pressure surface or suction surface.

According to the turbine blade of the present disclosure having the above-described configuration, since the cooling holes disposed in the squealer tip are protected in the undercut, there is no plugging problem in the cooling holes even when tip rubbing occurs in the turbine blade, thereby reducing the leakage of the combustion gas through the tip gap and improving the cooling effect.

Further, a positive function and a role of the squealer tip can be obtained by appropriately designing the arrangement and structure of the cooling holes and an undercut formed on a pressure surface and a suction surface, respectively, on the squealer tip.

DETAILED DESCRIPTION OF THE DISCLOSURE

Figure 1:
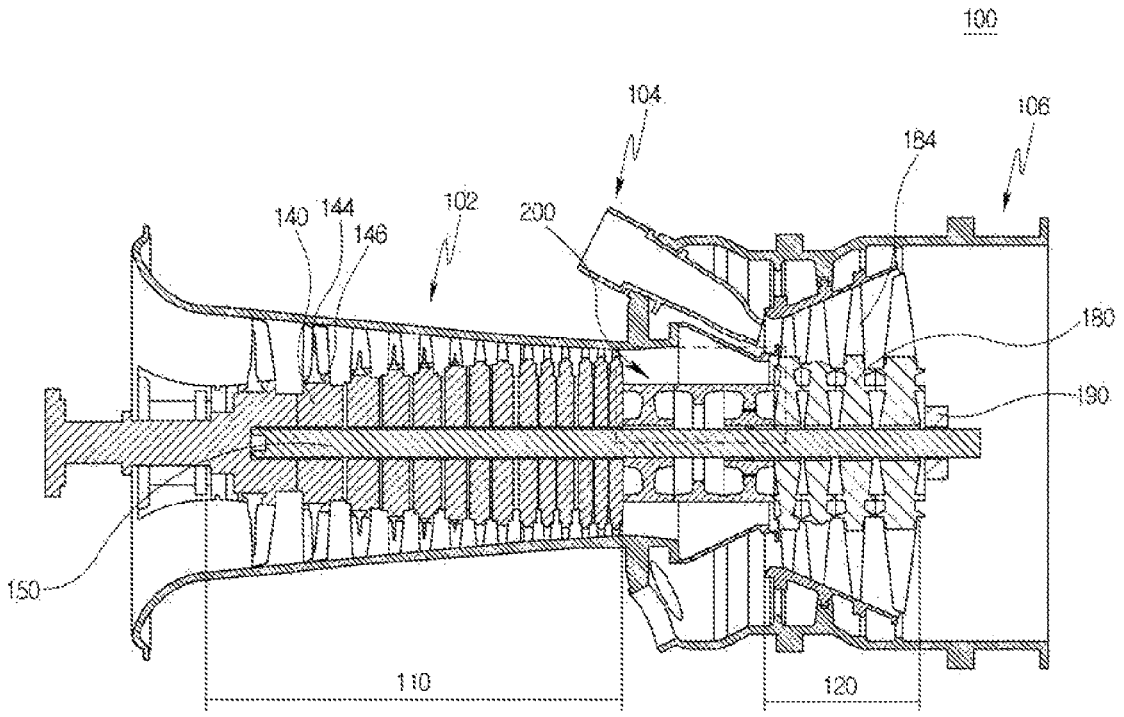
FIG. 1 is a cross-sectional view illustrating a schematic structure of a gas turbine according to an embodiment of the present disclosure.

Hereinafter, exemplary embodiments of the present disclosure will be described in detail with reference to the accompanying drawings. However, it should be noted that the present disclosure is not limited thereto, but may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the term "comprising" or "including" specifies the presence of stated feature, number, step, operation, element, part, or combination thereof, but does not preclude the presence or addition of one or more other features, numbers, steps, operations, elements, parts, or combinations thereof.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

Referring to FIG. 1, an example of a gas turbine 100 to which an embodiment of the present disclosure is applied is shown. The gas turbine 100 includes a housing 102 and a diffuser 106 which is disposed on a rear side of the housing 102 and through which a combustion gas passing through a turbine is discharged. A combustor 104 is disposed in front of the diffuser 106 so as to receive and burn compressed air.

Referring to the flow direction of the air, a compressor section 110 is located on the upstream side of the housing 102, and a turbine section 120 is located on the downstream side of the housing. A torque tube is disposed as a torque transmission member between the compressor section 110 and the turbine section 120 to transmit the rotational torque generated in the turbine section 120 to the compressor section 110.

The compressor section 110 is provided with a plurality (for example, 14) of compressor rotor disks 140, which are fastened by a tie rod 150 to prevent axial separation thereof.

Specifically, the compressor rotor disks 140 are axially arranged with the tie rod 150 passing through substantially central portion thereof. Here, the neighboring compressor rotor disks 140 are disposed so that opposed surfaces thereof are pressed by the tie rod 150 and the neighboring compressor rotor disks do not rotate relative to each other.

A plurality of blades 144 are radially coupled to outer circumferential surfaces of the compressor rotor disks 140. Each of the blades 144 has a root portion 146 which is fastened to the compressor rotor disk 140.

Vanes (not shown) fixed to the housing are respectively positioned between the rotor disks 140. Unlike the rotor disks, the vanes are fixed to the housing and do not rotate. The vane serves to align a flow of compressed air that has passed through the blades 144 of the compressor rotor disk 140 and guide the air to the blades 144 of the rotor disk 140 located on the downstream side.

The fastening method of the root portion 146 includes a tangential type and an axial type. These may be chosen according to the required structure of the commercial gas turbine, and may have a generally known dovetail or fir-tree shape. In some cases, it is possible to fasten the blades to the rotor disk by using other fasteners, such as keys or bolts in addition to the fastening shape.

The tie rod 150 is arranged to pass through the center of the compressor rotor disks 140 such that one end thereof is fastened in the compressor rotor disk located on the most upstream side and the other end thereof is fastened in the torque tube 130.

The shape of the tie rod 150 is not limited to that shown in FIG. 1, but may have a variety of structures depending on the gas turbine. That is, as shown in the drawing, the tie rod 150 may have a shape passing through a central portion of the rotor disks 140, a plurality of tie rods may be arranged in a circumferential manner, or a combination thereof may be used.

Although not shown, the compressor of the gas turbine 100 may be provided with a vane serving as a guide element at the next position of the diffuser 106 in order to adjust a flow angle of a pressurized fluid entering a combustor inlet to a designed flow angle. The vane is referred to as a deswirler.

The combustor 104 mixes the introduced compressed air with fuel and combusts the air-fuel mixture to produce a high-temperature and high-pressure combustion gas. With an isobaric combustion process in the compressor, the temperature of the combustion gas is increased to the heat resistance limit that the combustor and the turbine components can withstand.

The combustor comprises a plurality of combustors, which is arranged in the casing formed in a cell shape, and includes a burner having a fuel injection nozzle and the like, a combustor liner forming a combustion chamber, and a transition piece as a connection between the combustor and the turbine, thereby constituting a combustion system of the gas turbine 100.

Specifically, the combustor liner provides a combustion space in which the fuel injected by the fuel nozzle is mixed with the compressed air of the compressor and the fuel-air mixture is combusted. Such a liner may include a flame canister providing a combustion space in which the fuel-air mixture is combusted, and a flow sleeve forming an annular space surrounding the flame canister. A fuel nozzle is coupled to the front end of the liner, and an igniter is coupled to the side wall of the liner.

On the other hand, a transition piece is connected to a rear end of the liner so as to transmit the combustion gas to the turbine side. An outer wall of the transition piece is cooled by the compressed air supplied from the compressor so as to prevent thermal breakage due to the high temperature combustion gas.

To this end, the transition piece is provided with cooling holes through which compressed air is injected into and cools inside of the transition piece and flows towards the liner.

The air that has cooled the transition piece flows into the annular space of the liner and the compressed air is supplied as a cooling air to the outer wall of the liner from outside of a flow sleeve through the cooling holes provided in the flow sleeve so that both air flows may collide with each other.

In the meantime, the high-temperature and high-pressure combustion gas from the combustor is supplied to the turbine section 120. The supplied high-temperature and high-pressure combustion gas expands and collides with and provides a reaction force to rotating blades of the turbine to cause a rotational torque, which is then transmitted to the compressor section 110 through the torque tube. Here, an excess of power required to drive the compressor is used to drive a generator or the like.

The turbine section 120 is basically similar in structure to the compressor section 110. That is, the turbine section 120 is also provided with a plurality of turbine rotor disks 180 similar to the compressor rotor disks 140 of the compressor section 110. Thus, the turbine rotor disk 180 also includes a plurality of turbine blades 184 disposed radially. The turbine blade 184 may also be coupled to the turbine rotor disk 180 in a dovetail coupling manner, for example. Between the blades 184 of the turbine rotor disk 180, a vane (not shown) fixed to the housing is provided to induce a flow direction of the combustion gas passing through the blades.

Figure 2:
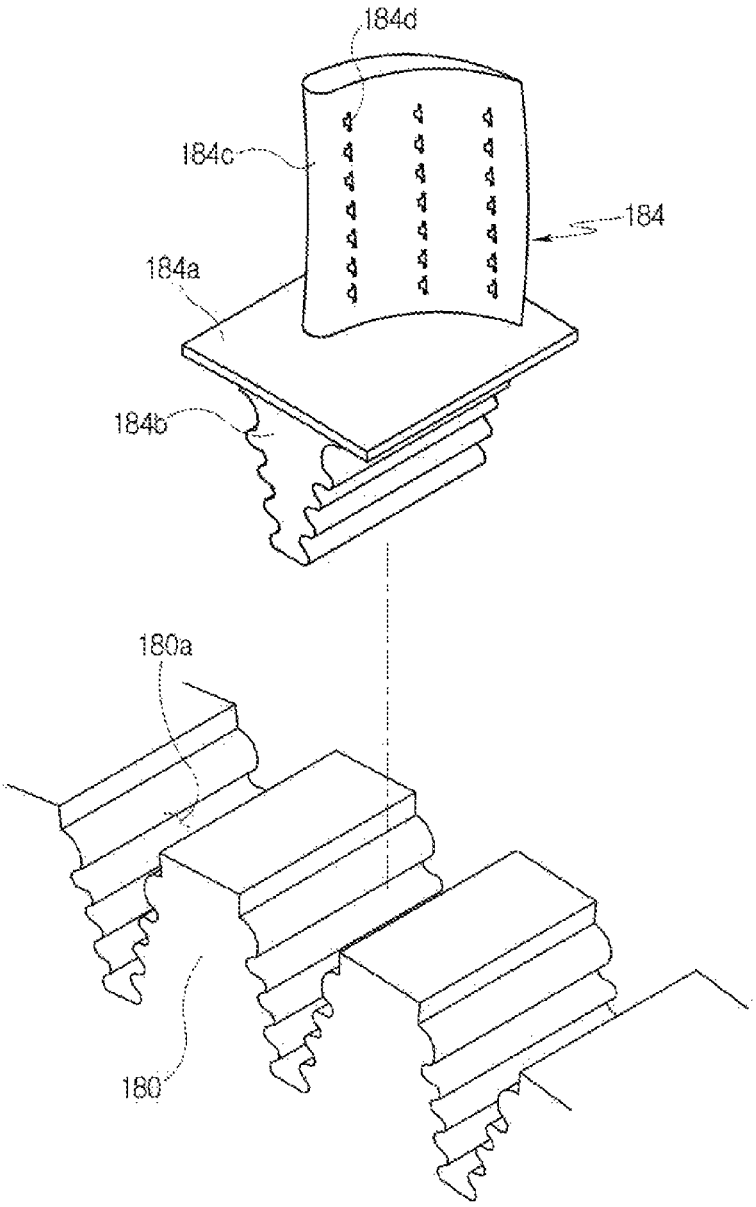
FIG. 2 is an exploded perspective view illustrating a turbine rotor disk of the gas turbine shown in FIG. 1.

Referring to FIG. 2, the turbine rotor disk 180 has a substantially disk shape, and a plurality of coupling slots 180*a* is formed in an outer circumferential portion thereof. The coupling slot 180*a* has a curved surface in the form of a fir-tree in an embodiment.

The turbine blade 184 is fastened to the coupling slot 180*a*. In FIG. 2, the turbine blade 184 has a planar platform part 184*a* approximately at the center thereof. The platform parts 184*a* of the neighboring turbine blades abut against each other at lateral sides thereof, thereby serving to maintain the gap between the neighboring blades. A root part 184*b* is formed on the bottom surface of the platform part 184*a*. The root part 184*b* has a so-called axial-type shape, which is inserted along the axial direction into the coupling slot 180*a* of the rotor disk 180.

The root part 184*b* has a substantially fir-shaped curved surface, which is formed to correspond to the shape of the curved surface of the coupling slot 180*a*. In another example, the coupling structure of the root part 184*b* does not necessarily have a fir shape, but may be formed to have a dovetail shape.

A blade part 184*c* is formed on an upper surface of the platform part 184*a*. The blade part 184*c* is formed to have an airfoil optimized according to the specification of the gas turbine and has a leading edge disposed on the upstream side and a trailing edge disposed on the downstream side with respect to the flow direction of the combustion gas.

Here, unlike the blades of the compressor section 110, the blades of the turbine section 120 come into direct contact with the high-temperature and high-pressure combustion gas. Since the temperature of the combustion gas is as high as 1,700° C., a cooling means is required. For this purpose, cooling paths are provided at some positions of the compressor section 110 to additionally supply compressed air towards the blades of the turbine section 120.

The cooling path may extend outside the housing (external path), extend through the interior of the rotor disk (internal path), or both the external and internal paths may be used. In FIG. 2, a plurality of film cooling holes 184*d* is formed on the surface of the blade part. The film cooling holes 184*d* communicate with a cavity (e.g., cooling path, not shown) formed inside the blade part 184*c* so as to supply cooling air to the surface of the blade part 184*c*.

In the meantime, FIGS. 3 to 6 illustrate characteristic configuration of the present disclosure. In FIGS. 3 to 6, a turbine blade having a squealer tip will be described, wherein reference numerals are newly assigned to the components in order to distinguish the configuration of a conventional gas turbine from that of the present disclosure.

Figure 3:
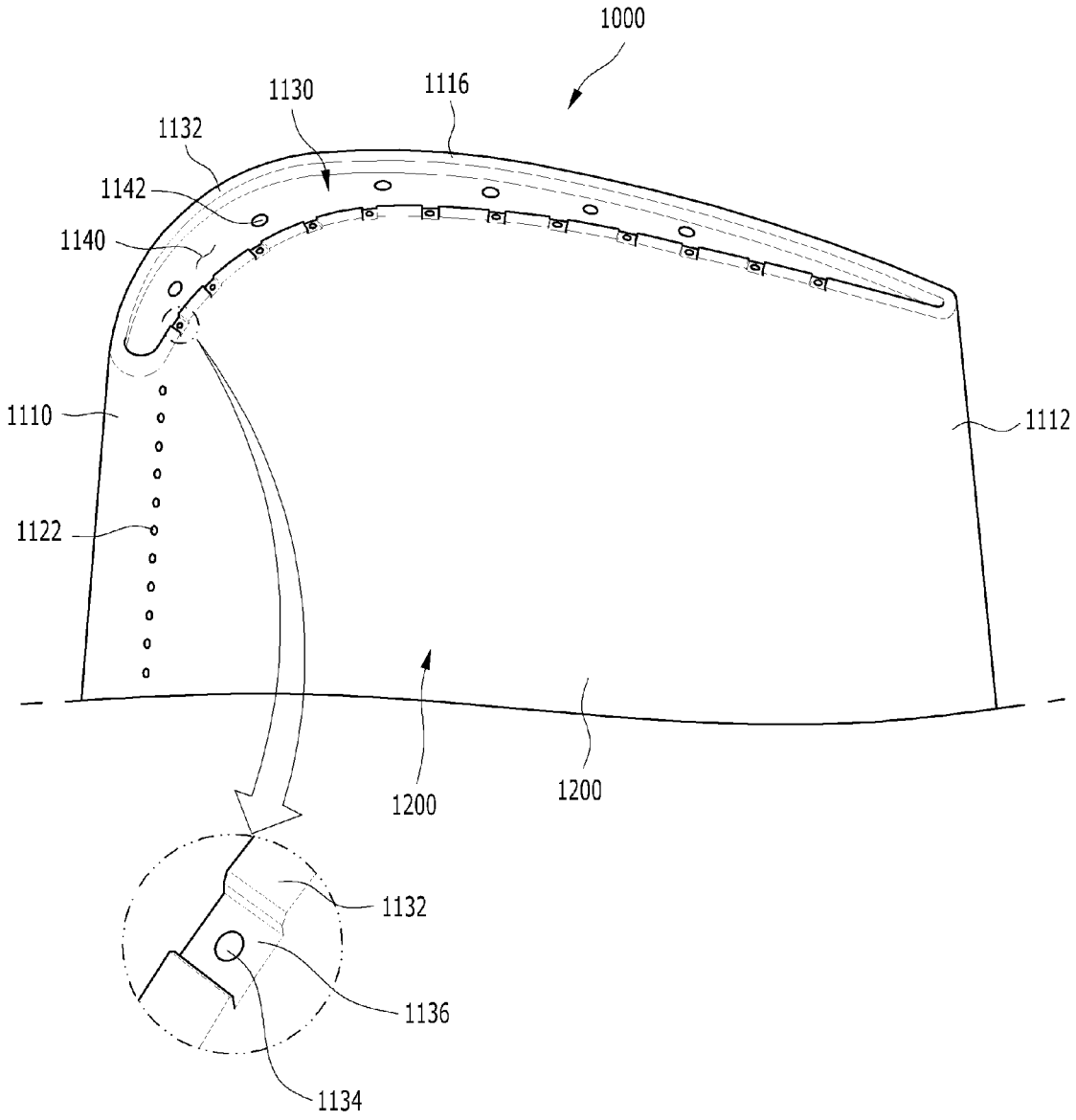
FIG. 3 is a detailed view illustrating a tip portion of the turbine blade according to an embodiment of the present disclosure.
Figure 4:
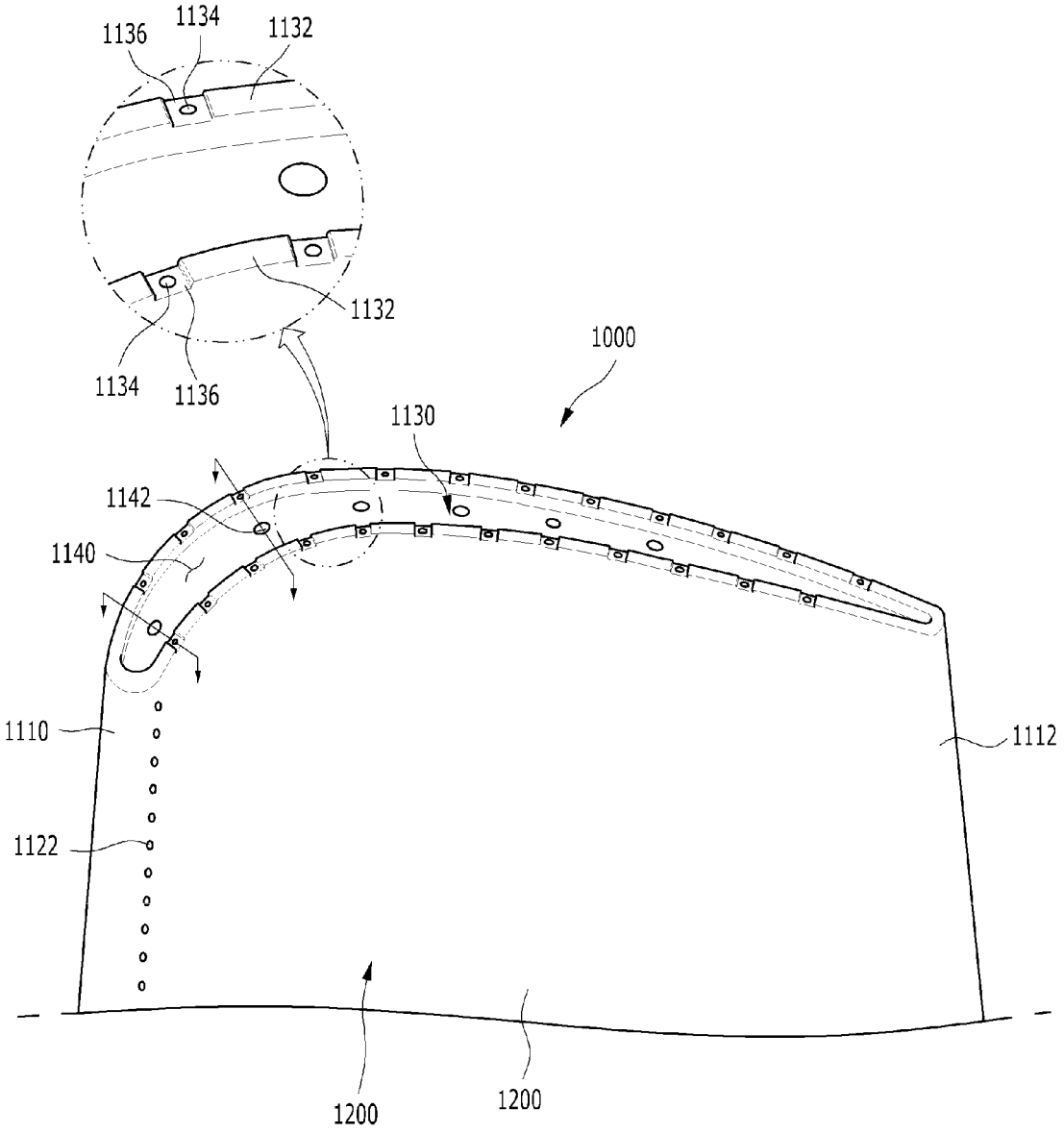
FIG. 4 is a detailed view illustrating a tip portion of the turbine blade according to another embodiment of the present disclosure.

FIG. 3 is a detailed view of a tip portion 1130 of a turbine blade 1000 according to an embodiment of the present disclosure. As shown, the turbine blade 1000 has the configuration in which a blade part 1100 extends radially from a platform part (FIG. 2) to the tip portion 1130 as a free end thereof, wherein the blade part has a cross section of an airfoil including a leading edge 1110 and a trailing edge 1112, and a pressure surface 1114 and a suction surface 1116 connecting the leading edge 1110 and the trailing edge 1112.

The turbine blade 1000 is provided with a cavity 1120 (FIGS. 5 and 6) in which a cooling air flows and is discharged to the surface of the blade part 1100 through cooling holes formed in a wall surface of the blade part 1100. For example, the cooling air discharged through film cooling holes 1122 provided on the pressure surface 1114 and the suction surface 1116 including the leading edge 1110 and the trailing edge of the blade part 1100 forms a film cooling layer on the surface of the blade part 1100 to protect the turbine blade 1000 from a high temperature combustion gas.

Figure 5:
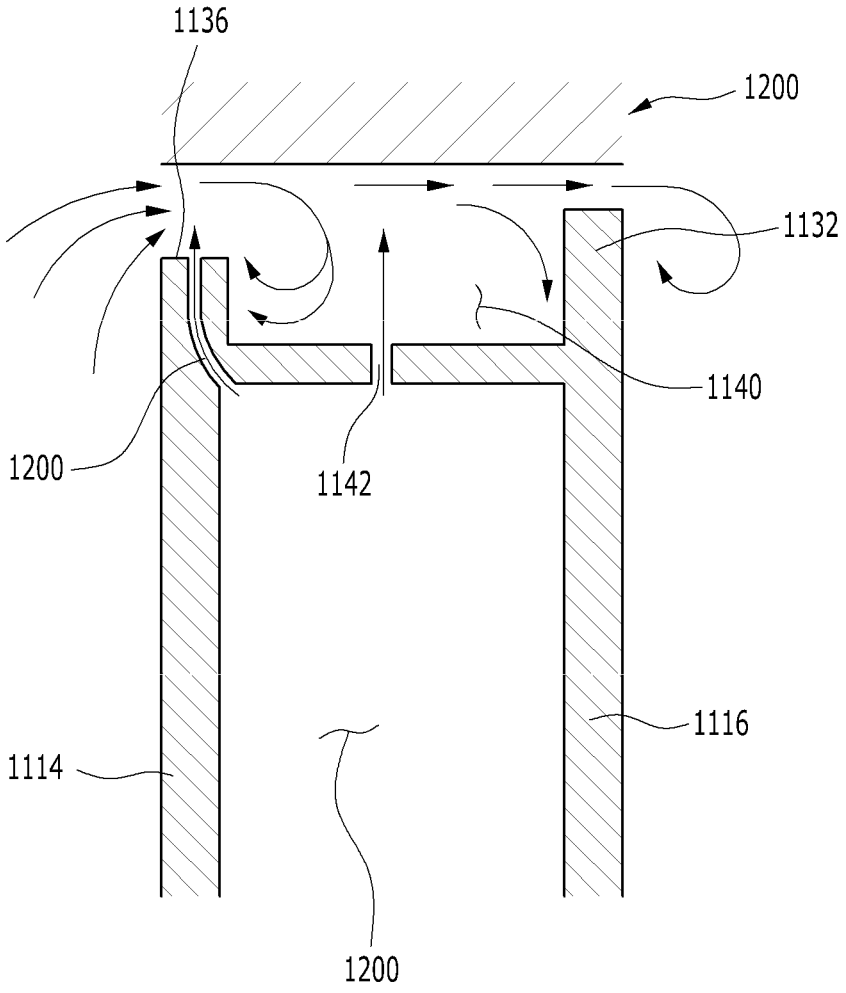
FIG. 5 is a cross-sectional view taken along line A-A in FIG. 4.
Figure 6:
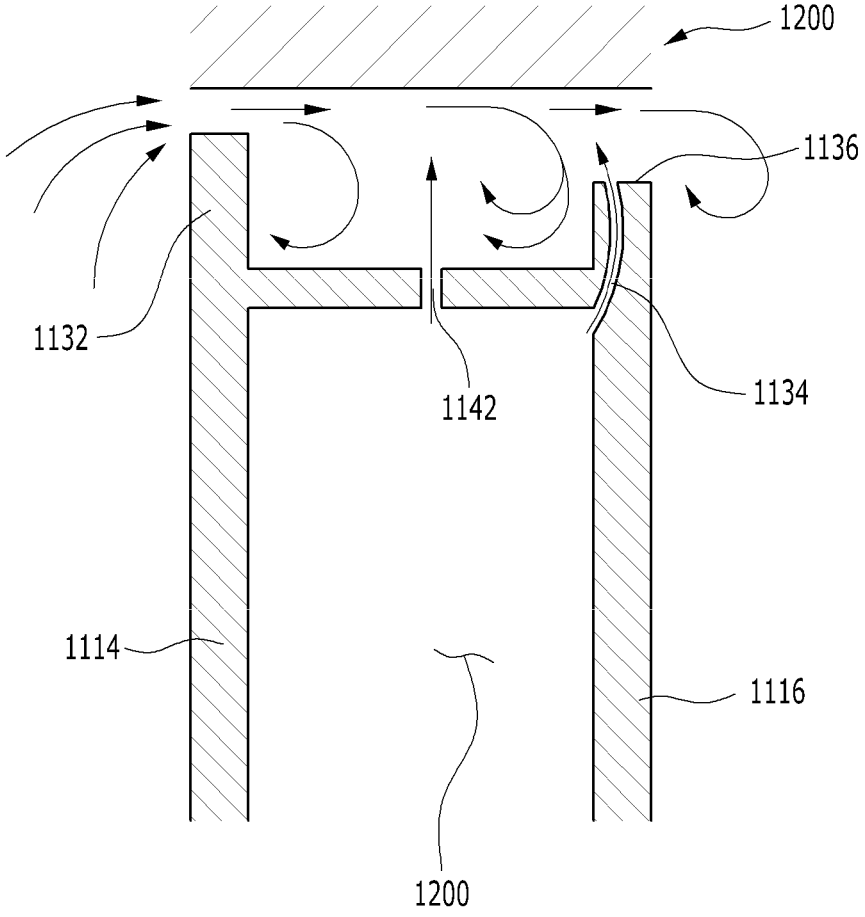
FIG. 6 is a cross-sectional view taken along line B-B in FIG. 4.

Although FIGS. 5 and 6 schematically show that the entire interior of the blade part 1100 is formed as a single cavity 1120, the cavity may be formed with a meandering cooling path in which wall surfaces are alternately arranged up and down inside the cavity 1120 so that cooling air flows through the meandering cooling path.

In the turbine blade 1000, a squealer tip 1132 having a predetermined thickness protrudes along the edge of the tip portion 1130 forming the free end of the blade part 1100 so that a squealer pocket 1140 is formed inside of the tip portion 1130 so as to be surrounded by the squealer tip 1132.

The squealer tip 1132 may be a kind of wall structure formed along the edge of the tip portion 1130. The squealer tip 1132 is known to be useful for controlling the flow of combustion gas that unnecessarily leaks through the tip portion 1130 of the turbine blade 1000. In other words, the squealer tip 1132 may have a positive effect in reducing the amount of leakage of the combustion gas escaping through the gap between the tip portion 1130 and an inner surface of the turbine casing (e.g., the surface of a ring segment). This is because the combustion gas leaking through the gap of the tip portion 1130 collides with the surface of the ring segment 1200 in the squealer pocket 1140 surrounded by the squealer tip 1132 and is circulated in the squealer pocket to provide a reverse air flow, which interferes with a subsequently introduced air flow and causes stagnation.

Furthermore, if cooling holes 1134 communicating with the inner cavity 1120 is radially formed through the squealer tip 1132, it is more effective to improve the cooling performance of the tip portion 1130 and reduce the amount of the leakage gas. This is because the cooling air discharged in the radial direction through the cooling holes 1134 of the squealer tip directly cools the tip portion 1130 and also acts as a barrier against the leaking combustion gas while simultaneously distributing the flow of the combustion gas to the ring segment 1200, thus contributing to the formation of swirling flow in the squealer pocket 1140.

However, even if the cooling holes 1134 of the squealer tip have a positive effect, there is a problem in actually applying the cooling holes 1134 of the squealer tip. The cooling holes 1134 are formed on the squealer tip 1132 provided at the end of the blade part 1100 so that if the tip portion 1130 of the turbine blade 1000 comes into contact with the inner surface of the turbine casing due to the thermal expansion or vibration, the thin-walled squealer tip 1132 is easily worn out so that the problem of plugging may occur on the cooling holes 1134 due to the rubbing of the squealer tip 1132. For this reason, actually, there are not many examples in which the squealer tip 1132 and the cooling holes 1134 thereof are applied.

The present disclosure is provided to solve the problem of plugging the cooling holes 1134 of the squealer tip by the rubbing of the squealer tip 1132 and is characterized in that undercuts 1136 are formed around the cooling holes 1134 along the circumferential direction of the squealer tip.

The undercut 1136 serves to lower the outlet of the cooling hole 1134 of the squealer tip below the upper surface of the squealer tip 1132 around the cooling hole so that even if the squealer tip 1132 is worn out, the cooling hole 1134 is protected in the undercut 1136, so that the problem of plugging the cooling hole 1134 does not occur. Opposite wall surfaces radially formed by the undercut 1136 serve to guide the cooling air discharged from the cooling hole 1134 towards the upper side of the tip portion 1130 (radially outward), thereby allowing the cooling air to serve as a barrier for reducing leakage of the combustion gas.

Further, by chamfering or filleting the edges forming the boundary between the upper surface of the squealer tip 1132 and the undercut 1136 (see the enlarged view of FIG. 3), the edges of the undercut may be prevented from being unintentionally worn out and deformed and disturbing the flow of cooling air.

Here, although the cooling holes 1134 may be formed on both the pressure surface 1114 and the suction surface 1116 on the airfoil section, it may be desirable that the cooling holes 1134 are essentially provided at least on the pressure surface 1114. In the airfoil structure of the blade part 1100, since the pressure of the high-pressure combustion gas flowing through the blade part 1100 is higher on the pressure surface 1114 than the suction surface 1116, a pressure gradient is formed in which the combustion gas flows from the pressure surface 1114 toward the suction surface 1116 at the tip portion 1130. Further, since a cross section of the blade part 1100 gradually decreases from the platform part to the tip portion 1130, the combustion gas acting on the pressure surface 1114 of the blade part 1100 flows upwards to the tip portion 1130.

The pressure gradient and rising flow of the combustion gas on the blade part 1100 cause a great amount of combustion gas to flow from the pressure surface 1114 toward the suction surface 1116 in the tip portion 1130. Since this flow is associated directly with the leakage of the combustion gas through the gap of the tip portion 1130, it will be important to essentially form the cooling holes 1134 in the undercuts 1136 on the pressure surface as an inlet side of the combustion gas leakage.

In the case where the cooling holes 1134 of the squealer tip are formed on both the pressure surface 1114 and the suction surface 1116 on the airfoil section, the cooling holes 1134 formed on the pressure surface 1114 and the suction surface 1116, respectively, may preferably be staggered so as not to overlap with each other with respect to the circumferential direction. For example, each of the cooling holes 1134 formed on the suction surface 1116 may be located along an imaginary line extending orthogonal to the pressure surface 1114 at the midpoint of two adjacent cooling holes 1134 formed on the pressure surface 1114.

Although cooling air is discharged at the portion where the cooling holes 1134 are present, it is difficult for the portion of the squealer tip 1132 between the adjacent cooling holes 1134, which is, between the undercuts 1136, to obtain the effect of reducing the gas leakage by the discharged cooling air. That is, the combustion gas easily passes through the gap around the squealer tip 1132 between the undercuts 1136. In view of this, by arranging the cooling holes 1134 formed in the pressure surface 1114 and the suction surface 1116 in a staggered manner so as not to overlap with each other with respect to the circumferential direction, the combustion gas that easily passes through the tip 1132 of the pressure surface 1114 towards the suction surface 1116 may be blocked by the cooling air discharged out of the cooling holes 1134 of the suction surface 1116 so that the combustion gas is held in the squealer pocket 1140 for a longer period of time.

The cooling holes 1134 may be formed on the pressure surface 1114 to radially discharge the cooling air therethrough, and the cooling holes 1134 may be formed in an inclined manner on the suction surface 1116 to discharge the cooling air in a direction towards the squealer pocket 1140.

Since the cooling holes 1134 formed on the pressure surface 1114 discharge the cooling air that will be firstly encountered by the combustion gas leaking through the gap of the tip portion 1130, inclined discharge of the cooling air towards the squealer pocket 1140 is not desirable. Further, inclination towards the pressure surface 1114 is also undesirable since the cooling air is discharged out of the tip portion 1130. Therefore, as shown in FIG. 5, it is appropriate that the cooling holes 1134 formed on the pressure surface 1114 side are formed to discharge the cooling air in a direction parallel to the radial direction.

In contrast, the cooling holes 1134 formed on the suction surface 1116 are provided to prevent leakage of the combustion gas that has been introduced into the squealer pocket 1140, and in order to form a swirling flow in the combustion gas. Thus, it may be advantageous to discharge the cooling air more strongly toward the combustion gas. Thus, as illustrated in FIG. 6, it may be preferable that the outlet portion of the cooling hole 1134 formed on the suction surface 1116 is formed in an inclined manner to discharge the cooling air in the direction toward the squealer pocket 1140.

In addition, the undercut 1136 formed by cutting the squealer tip 1132 along the circumferential direction may be formed to be inclined with respect to the pressure surface 1114 or the suction surface 1116. This is because when the pressure of the cooling air is insufficient or the pressure of the combustion gas is high since the gas turbine is not yet under rated operation, the undercut 1136, which is the leakage path of the combustion gas, is formed not in a straight manner, but in an inclined manner, so as to provide resistance during the passage of the combustion gas.

As illustrated in FIGS. 3 to 6, the squealer pocket 1140 may be radially provided with cooling holes 1142 communicating with the cavity 1120 inside the turbine blade 1000. The cooling air discharged from the cooling holes 1142 also helps to cool the tip portion 1130, and to serve as an internal barrier against the combustion gas introduced into the squealer pocket 1140 so as to form a swirling flow of combustion gas.

While the embodiments of the present disclosure have been described, it will be apparent to those skilled in the art that various modifications and variations can be made in the present disclosure through addition, change, omission, or substitution of components without departing from the spirit of the disclosure as set forth in the appended claims. For example, the present disclosure may also be applied to the case where turbine blades other than compressor blades are coupled in a dovetail joint manner, and such modifications and changes may also be included within the scope of the present disclosure.

The invention claimed is:

1. A turbine blade comprising:

a blade part having an airfoil in a cross section including a leading edge, a trailing edge, and a pressure surface and a suction surface connecting the leading edge and the trailing edge, the blade part extending radially from a platform part to a tip portion as a free end in the turbine blade, wherein a cavity through which cooling air flows is formed inside the turbine blade, wherein a squealer tip having a predetermined thickness protrudes along an edge of the tip portion so that a squealer pocket is formed on an inner side of the tip portion by the squealer tip, wherein the squealer tip is provided with at least one cooling hole communicating with the cavity along a radial direction of the turbine blade, wherein an undercut is formed around the at least one cooling hole of the squealer tip by cutting a part of the squealer tip in a circumferential direction, and wherein the at least one cooling hole formed on the suction surface is formed in an inclined manner to discharge the cooling air in a direction toward the squealer pocket.

2. The turbine blade of claim 1, wherein the at least one cooling hole of the squealer tip is formed on the pressure surface or the suction surface on the airfoil in the cross section.

3. The turbine blade of claim 2, wherein the at least one cooling hole is formed on both the pressure surface and the suction surface on the airfoil in the cross section such that the at least one cooling hole respectively formed on the pressure surface and the suction surface is staggered so as not to overlap with each other with respect to the circumferential direction.

4. The turbine blade of claim 3, wherein the at least one cooling hole formed on the suction surface is located along a line extending in a direction orthogonal to the pressure surface at an intermediate point of two adjacent cooling holes formed on the pressure surface.

5. The turbine blade of claim 3, wherein the at least one cooling hole formed on the pressure surface is formed to discharge the cooling air in a direction parallel to the radial direction.

6. The turbine blade of claim 1, wherein an edge forming a boundary between an upper surface of the squealer tip and the undercut is chamfered or a fillet-machined.

7. The turbine blade of claim 1, wherein the squealer pocket is provided with a cooling hole communicating with the cavity along the radial direction of the turbine blade.

8. A turbine blade assembly comprising:

a blade part and a rotor disk, the blade part having an airfoil in a cross section including a leading edge, a trailing edge, and a pressure surface and a suction surface connecting the leading edge and the trailing edge, the blade part extending radially from a platform part to a tip portion as a free end in the turbine blade, the rotor disk circumferentially having a coupling slot through which a root part formed on a bottom surface of the platform part of the turbine blade is inserted, wherein a cavity through which cooling air flows is formed inside the turbine blade, wherein a squealer tip having a predetermined thickness protrudes along an edge of the tip portion so that a squealer pocket is formed on an inner side of the tip portion by the squealer tip, wherein the squealer tip is provided with at least one cooling hole communicating with the cavity along a radial direction of the turbine blade, wherein an undercut is formed around the at least one cooling hole of the squealer tip by cutting a part of the squealer tip in a circumferential direction, and wherein the at least one cooling hole formed on the suction surface is formed in an inclined manner to discharge the cooling air in a direction toward the squealer pocket.

9. The turbine blade assembly of claim 8, wherein the at least one cooling hole of the squealer tip is formed on the pressure surface or the suction surface on the airfoil in the cross section.

10. The turbine blade assembly of claim 9, wherein the at least one cooling hole is formed on both the pressure surface and the suction surface on the airfoil in the cross section such that the at least one cooling hole respectively formed on the pressure surface and the suction surface is staggered so as not to overlap with each other with respect to the circumferential direction.

11. The turbine blade assembly of claim 10, wherein the at least one cooling hole formed on the pressure surface is formed to discharge the cooling air in a direction parallel to the radial direction.

12. A gas turbine comprising:

a combustor mixing fuel with compressed air to provide a fuel-air mixture and combusting the fuel-air mixture to generate an expanding high-temperature combustion gas, and a turbine receiving the combustion gas generated in the combustor and converting a reaction force of the combustion gas to a rotary motion of a turbine blade, wherein the turbine blade comprises a blade part having an airfoil in a cross section including a leading edge, a trailing edge, and a pressure surface and a suction surface connecting the leading edge and the trailing edge, the blade part extending radially from a platform part to a tip portion as a free end in the turbine blade, wherein a cavity through which cooling air flows is formed inside the turbine blade, wherein a squealer tip having a predetermined thickness protrudes along an edge of the tip portion so that a squealer pocket is formed on an inner side of the tip portion by the squealer tip, wherein the squealer tip is provided with at least one cooling hole communicating with the cavity along a radial direction of the turbine blade, wherein an undercut is formed around the at least one cooling hole of the squealer tip by cutting a part of the squealer tip in a circumferential direction, and wherein the at least one cooling hole formed on the suction surface is formed in an inclined manner to discharge the cooling air in a direction toward the squealer pocket.

13. The gas turbine of claim 12, wherein the at least one cooling hole of the squealer tip is formed on the pressure surface or the suction surface on the airfoil in the cross section.

14. The gas turbine of claim 13, wherein the at least one cooling hole is formed on both the pressure surface and the suction surface on the airfoil in the cross section such that the at least one cooling hole respectively formed on the pressure surface and the suction surface is staggered so as not to overlap with each other with respect to the circumferential direction.

15. The gas turbine of claim 14, wherein the at least one cooling hole formed on the pressure surface is formed to discharge the cooling air in a direction parallel to the radial direction.

* * * * *